US008661692B2

(12) United States Patent
Whited et al.

(10) Patent No.: US 8,661,692 B2
(45) Date of Patent: Mar. 4, 2014

(54) SPLIT BLADE HOUSING FOR POWER OPERATED ROTARY KNIFE

(75) Inventors: Jeffrey A. Whited, Amherst, OH (US); Richard P. Bozzi, Vermilion, OH (US)

(73) Assignee: Bettcher Industries, Inc., Birmingham, OH (US)

( * ) Notice: Subject to any disclaimer, the term of this patent is extended or adjusted under 35 U.S.C. 154(b) by 2113 days.

(21) Appl. No.: 11/588,572

(22) Filed: Oct. 27, 2006

(65) Prior Publication Data

US 2008/0098605 A1 May 1, 2008

(51) Int. Cl.
*B26B 7/00* (2006.01)

(52) U.S. Cl.
USPC ..... 30/276; 30/329

(58) Field of Classification Search
USPC ..... 30/276, 329, 332, 347; 452/133, 137
See application file for complete search history.

(56) References Cited

U.S. PATENT DOCUMENTS

| | | | | |
|---|---|---|---|---|
| 4,575,938 | A * | 3/1986 | McCullough | 30/276 |
| 5,761,817 | A * | 6/1998 | Whited et al. | 30/276 |
| 6,662,452 | B2 * | 12/2003 | Whited | 30/276 |
| 6,694,649 | B2 * | 2/2004 | Whited et al. | 30/276 |
| 7,406,769 | B1 * | 8/2008 | Toussaint | 30/93 |

* cited by examiner

*Primary Examiner* — Robert Scruggs
(74) *Attorney, Agent, or Firm* — Tarolli, Sundheim, Covell & Tummino LLP

(57) ABSTRACT

A split blade housing adapted to support an annular knife blade for rotation in a power operated rotary knife. The blade housing includes a mounting section and a body section extending from the mounting section and forming a ring. The mounting section of the split blade housing is adapted to be mounted to a handle assembly of the rotary knife and includes a recess providing clearance for a pinion gear that extends from the handle assembly to engage and drive the knife blade. The split blade housing includes an annular groove for rotatably supporting the knife blade, the groove defining a rotational plane of the knife blade. The split blade housing includes a split defining first and second end portions adjacent the split to facilitate removal of the knife blade from the housing. The housing split is peripherally offset from the mounting section recess and the split is transverse with respect to a center vertical axis of the blade housing.

18 Claims, 6 Drawing Sheets

SPLIT BLADE HOUSING FOR POWER OPERATED ROTARY KNIFE

FIELD OF THE INVENTION

The present invention relates to a split blade housing for a power operated rotary knife.

BACKGROUND OF THE INVENTION

Power operated rotary knives have been used in commercial meat processing operations to trim fat and connective tissue from meat, trim pieces of meat from bones, and to produce meat slices. Such knives usually comprise a handle, blade housing and a rotary knife blade. The knife blade includes an annular body and driving gear teeth projecting axially from the body oppositely from the blade cutting section. The blade housing supports and maintains the position of the blade relative to the knife as the blade is rotated. A pinion gear mounted in a head member of the handle engages the driving gear teeth to rotate the knife blade. The pinion gear, in turn, is driven by a long, flexible drive shaft that extends through the handle. The knife operator wields the knife relatively freely at a meat cutting work station that is remote from the driving motor.

The blade of a power operated rotary knife must be replaced periodically. To permit easy removal of the blade from the blade housing, a split blade housing has been employed. Such a split blade housing is disclosed in U.S. Pat. No. 6,662,452, assigned to the assignee of the present invention. The '452 patent is incorporated herein in its entirety by reference.

In prior art rotary knives, the opening or split of the blade housing was located in a recessed portion of the blade housing that was radially and axially aligned with the pinion gear. The recessed portion of the blade housing provided a clearance region the drive teeth of the pinion gear which extended outwardly from the head member to engage the gear teeth of the knife blade. The split in the blade housing was aligned with the pinion gear recessed portion of the housing because the height of the blade housing in an axial direction is a minimum at that position.

It has been found that depending upon consistency the material being cut or trimmed with the power operated rotary knife, the opening or split of the blade housing tended to provide a passageway for the pieces of fat, meat and bone and other debris materials collected on the cutting section of the knife blade during use to migrate to the pinion gear and the intersection of the pinion gear and the drive teeth of the knife blade. Collecting debris materials in the region of the meshing of the pinion gear and knife blade drive teeth is undesirable because the heat generated by the driving engagement tends to "cook" the debris creating a sticky build up on the pinion gear and drive teeth and generating even more heat. Moreover, such a build up of debris and sticky materials may lead to increased vibration of the knife during operation and shortened blade and pinion gear life, all of which are detrimental to rotary knife performance.

What is needed is split blade housing for a power operated rotary knife that reduces the propensity of debris materials from being routed from the blade section of the knife blade to the a region of the pinion gear and knife blade drive teeth.

SUMMARY OF THE INVENTION

In one aspect, the present invention concerns a split blade housing adapted to support an annular knife blade for rotation in a power operated rotary knife. The housing includes a mounting section and a body section extending from the mounting section and forming a ring. The mounting section of the split blade housing is adapted to be mounted to a handle assembly of the rotary knife and includes a recess extending radially through the mounting section providing clearance for a pinion gear that extends from the handle assembly to engage and drive the knife blade. An inner surface of the split blade housing defines an annular groove for rotatably supporting the knife blade, the groove defining a rotational plane of the knife blade.

The split blade housing includes a split defining first and second end portions adjacent the split to facilitate removal of the knife blade from the housing by moving the first end portion of the split blade circumferentially away from the second end portion to expand a diameter of the split blade housing. The housing split is peripherally offset from the recess of the mounting section and the split is transverse with respect to a center vertical axis of the blade housing. Preferably, a direction of the split moving axially from an upper end of the split to a lower end of the split forms an acute angle with respect to the knife blade rotational plane defined by the housing groove. A horizontal component of a direction of the split when viewed from an upper portion of the split to a lower portion of the split, the lower portion of the split being closer to a cutting edge of the knife blade, is in a same direction as a tangential component of a direction of rotation of the knife blade at the split.

In one exemplary embodiment, the angle of the split with respect to the center vertical axis of the blade housing is in a range of 15-80 degrees. In another exemplary embodiment, the angle of the split is approximately 45 degrees.

In one exemplary embodiment, the split blade housing includes one or more axial slots in an outer wall of the blade housing adapted to facilitate expansion of the blade housing diameter while the blade housing remain attached to the handle assembly. Preferably, a portion of an inner surface of the mounting section includes an area of scoring to inhibit movement of the first end portion of the blade housing relative to the second end when the blade housing is secured to the handle assembly.

In another aspect, the present invention concerns a power operated rotary knife that includes an annular knife blade having a cutting edge at one axial end of the blade, a split blade housing supporting the annular knife blade for rotation, and a handle assembly including a head member for supporting the split blade housing and a clamping assembly including a clamp body for clamping the split blade housing to the head member. The head member supports a pinion gear that extends from the head member to engage and drive the annular knife blade.

The split blade housing includes a mounting section and a body section extending from the mounting section and forming a ring. The housing includes an annular groove for rotatably supporting the knife blade, the groove defining a rotational plane of the annular knife blade. A mounting section of the split blade housing is adapted to be mounted to a handle assembly of the rotary knife and includes a recess extending radially through the mounting section providing clearance for the pinion gear extending from the head member.

The blade housing includes a split defining first and second end portions adjacent the split to facilitate removal of the knife blade from the housing by moving the first end portion of the split blade circumferentially away from the second end portion to expand a diameter of the split blade housing. The split is offset peripherally from the recess and the split is transverse with respect to a center vertical axis of the blade housing. Preferably, a direction of the split moving axially from an upper end of the split to a lower end of the split, the lower end of the split being closer to the cutting edge of the blade, forms an acute angle with respect to the rotational plane of the knife blade defined by the groove. A component of a direction of the split when viewed from an upper portion of the split to a lower portion of the split is in a same direction as a tangential component of a direction of rotation of the knife blade at the split.

In one exemplary embodiment, the angle of the split with respect to the center vertical axis of the blade housing is in a range of 15-80 degrees. In another exemplary embodiment, the angle of the split is approximately 45 degrees.

In one exemplary embodiment, the split blade housing includes one or more axial slots in an outer wall of the blade housing adapted to facilitate expansion of the blade housing diameter when one side of the clamp body is loosened with respect to the head member. Preferably, a portion of an inner surface of the mounting section includes an area of scoring to inhibit movement of the first end portion of the blade housing relative to the second end when the blade housing is secured to the handle assembly.

These and other objects, features and advantages of the invention will become better understood from the detailed description of the preferred embodiments of the invention which are described in conjunction with the accompanying drawings.

DETAILED DESCRIPTION

Figure 1:
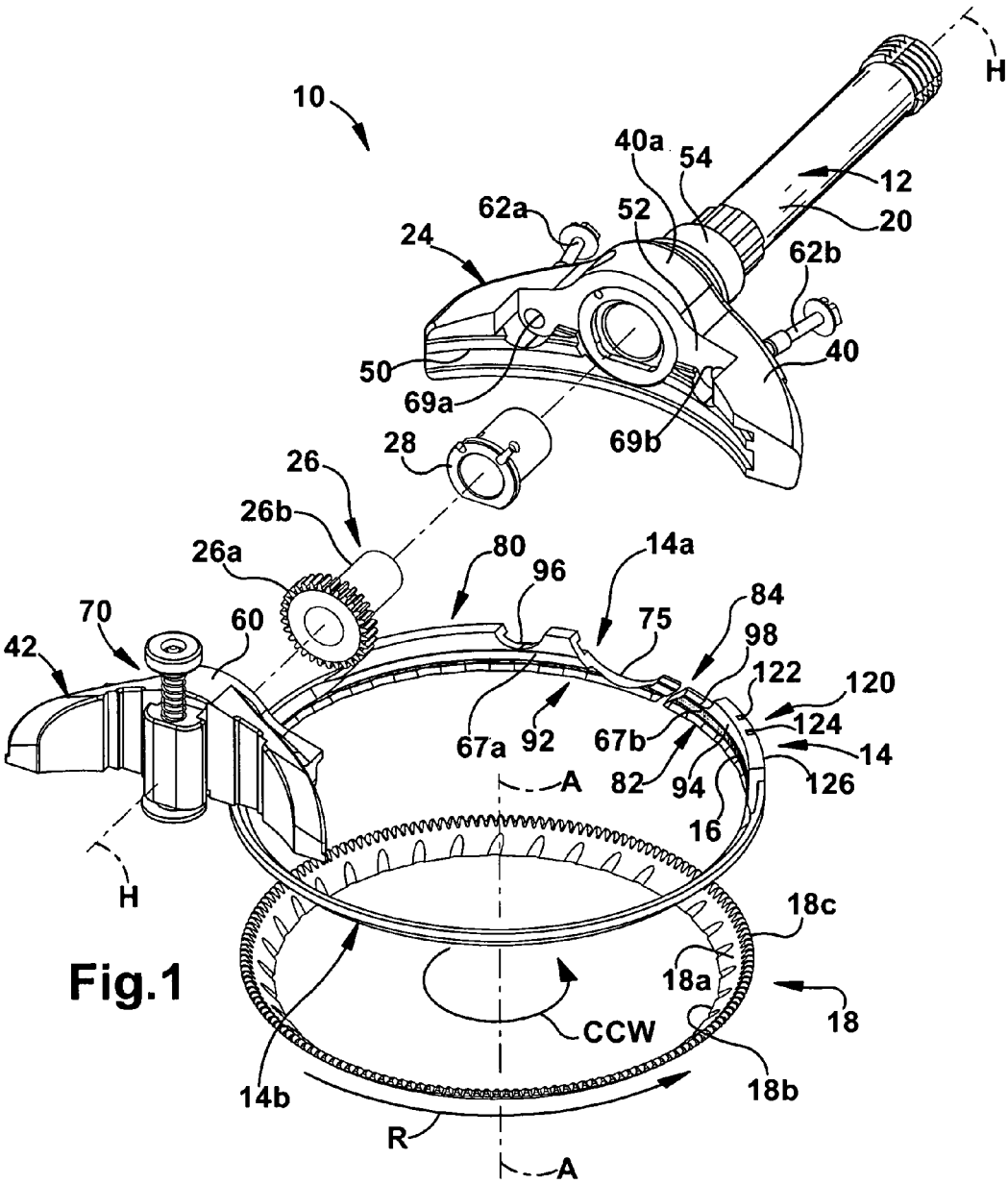
FIG. 1 is an exploded perspective view of a rotary knife of the present invention.

A power operated rotary knife 10 of the present invention is shown generally at 10 in FIG. 1. The knife 10 comprises a handle assembly 12, a generally ring-shaped, split blade housing 14 supported by the handle assembly 12, and an annular knife blade 18 supported by the blade housing 14 for rotation about an center axis of rotation A-A. The illustrated knife is connected to a remote electric motor by a flexible drive shaft so that the blade 18 is driven from the electric motor. The motor and drive shaft may be of any suitable or conventional construction and are not illustrated. It should be appreciated that other means may be employed to drive the blade 18. For example, an air motor may be mounted in the handle assembly 12 and connected to a source of pressurized air via a suitable hose, or an electric motor may be mounted in the handle assembly 12 and connected to a power source by a power cord. It is the intent of the present invention to cover all such drive systems.

As seen in FIG. 1, the annular knife blade 18 includes a body 18*a* and a cutting section 18*b* that extends downwardly and radially inwardly from the body 18*a*. Disposed on an upper surface of the blade body 18*a* is a plurality of gear teeth 18*c* which are used to rotatably drive the blade when the blade 18 is properly positioned in the blade housing 14. The cutting section or edge 18*b* of the blade 18 extends below a bottom surface 17 of the blade housing 14.

The illustrated handle assembly 12 extends away from the blade 18 and blade housing 14 along a centerline H-H that bisects the blade 18 and blade housing 14 and which is transverse (substantially perpendicular) to the axis of rotation A-A of the blade 18 thereby allowing a knife operator to comfortably wield the knife 10 with one hand. The handle assembly 12 comprises a handle supporting frame member 20, a head assembly 24 fixed to the frame member 20. As can be seen, the centerline H-H extends substantially along the frame member 20. A hand piece (not shown) surrounds frame member 20 and provides a gripping surface for an operator. The frame member 20 is adapted to receive various hand pieces having different configurations to permit an operator to select a grip which is most comfortable for the operator's hand.

The frame member 20 rigidly supports the head assembly 24, a blade driving pinion gear 26 and a pinion gear supporting bearing 28 while providing a channel through which the flex shaft (not shown) extends to make a driving connection with the pinion gear 26. The head assembly 24 secures the blade housing 14 and the blade 18 with respect to the frame member 20 while enabling their removal and replacement when desired. The illustrated head assembly 24 comprises a head member 40 and a clamp assembly 42 that detachably clamps the blade housing 14 and the blade 18 to the head member 40. The head assembly 24 also includes a conventional lubrication system (not shown) by which a relatively viscous, edible lubricant may be supplied to the pinion gear 26, the blade 18 and the blade housing 14 via suitable passages. An operator depresses a rubber-like diaphragm of the lubrication system (not shown) to force a flow of the lubricant into the gear teeth 26*a* of the pinion gear 26 from which the lubricant flows onto the blade 18 and is circulated about the blade housing 14.

The head member 40 positions the blade housing 14 relative to the handle assembly 12. The illustrated head member 40 is a generally crescent shaped, cast metal body 40*a* that defines a semicircular blade housing seating region 50, a clamp assembly receiving, socket-like cavity 52, and a boss 54 that surrounds the frame member 20 and projects from the head member body 40*a* along the centerline H-H of the handle assembly 12 opposite to the cavity 52 and seating region 50. The pinion gear bearing 28 is a tubular member that is fixed in the head member 40 and surrounds a shank 26*b* of the pinion gear. The clamp assembly 42 includes a steeling mechanism 70 by which the blade 18 can be straightened by a knife operator. The steeling mechanism 70 may be of any conventional or suitable construction and may be omitted from the knife 10 altogether if desired.

Figure 2:
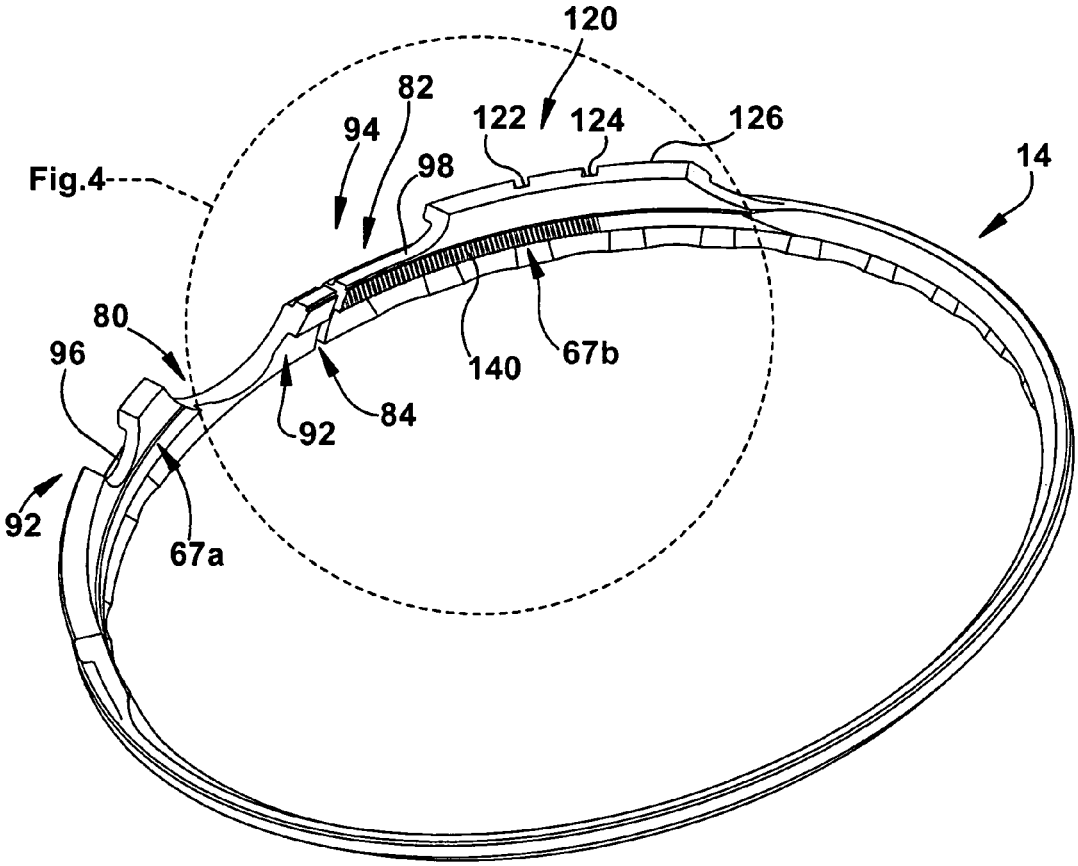
FIG. 2 is a perspective view of a split blade housing of the rotary knife of FIG. 1.
Figure 4:
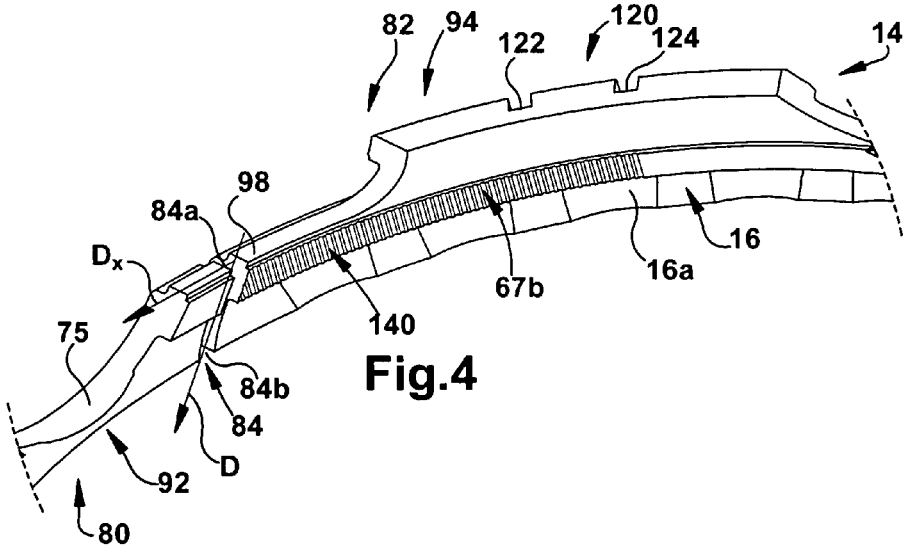
FIG. 4 is an enlarged perspective view of a circled portion of the split blade housing of FIG. 2.
Figure 8:
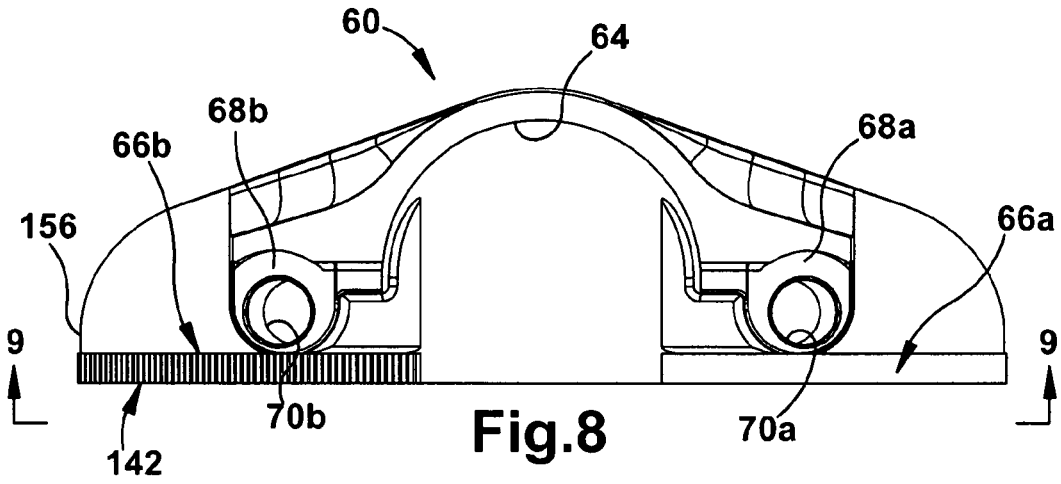
FIG. 8 is a front elevation view of a clamp body of the rotary knife of FIG. 1.
Figure 9:
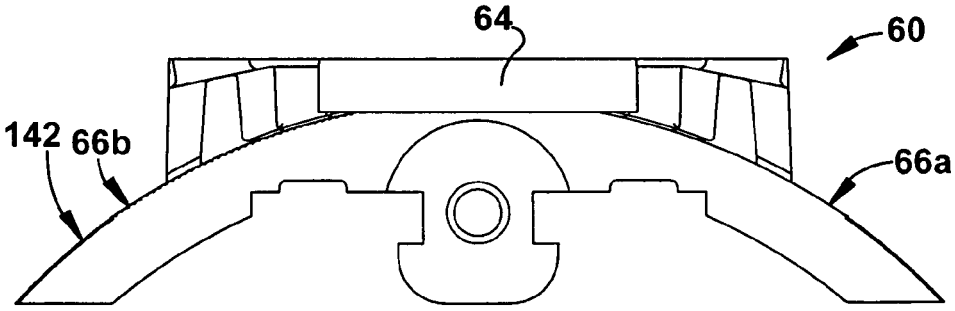
FIG. 9 is a bottom plan view of the clamp body of FIG. 8 as seen from a plane indicated by the line 9-9 in FIG. 8.

The clamp assembly 42 firmly maintains the blade housing 14 seated against the seating region 50 to rigidly position the blade 18 while covering the pinion gear 26 which might otherwise be directly exposed to meat, fat, bone chips, etc. The clamp assembly 42 comprises a clamp body 60 and clamping screws 62*a*, 62*b*. The clamp body 60 defines a semicircular recess 64 (FIGS. 8 and 9) confronting the head member 40 for receiving the pinion gear 26, outer peripheral bearing surfaces 66*a*, 66*b* that engage the blade housing 14 along inner peripheral bearing surfaces 67*a*, 67*b* (FIGS. 1, 2, and 4) on respective opposite sides of a split 84 of the blade housing, and clamping screw receiving bosses 68*a*, 68*b* (FIG. 8) that project past the blade housing 14 into the cavity 52.

The clamping screws 62*a*, 62*b* extend through respective holes 69*a*, 69*b* in the rear side of the head member 40 and into respective tapped holes 70*a*, 70*b* (FIG. 8) in the clamp body bosses 68*a*, 68*b*. The screws 62*a*, 62*b* are tightened to clamp the clamp body 60 against the blade housing 14. Each clamp face 66*a*, 66*b* exerts force on the blade housing bearing surfaces 67*a*, 67*b* that depends on the tension in the respective clamping screws 62*a*, 62*b*. The illustrated clamping screws 62*a*, 62*b* are unscrewed from the clamp body 60 to release the clamp body 60 and the blade housing 14 from the handle assembly 12. The screws 62*a*, 62*b* and head member holes 69*a*, 69*b* are preferably constructed so that the screws 62*a*, 62*b* are captured in the holes 69*a*, 69*b* when unscrewed from the clamp body 60. This prevents the screws 62*a*, 62*b* from being misplaced when changing the blade housing 14.

Advantageously, in the knife 10 of the present invention, the blade 18 may be removed and replaced without the necessity of removing the blade housing 14. The blade housing 14 forms a split ring-like structure that comprises an axially extending mounting section 14*a* and an annularly curved body section 14*b* extending from a lower portion 15 of the mounting section 14*a*. The mounting section 14*a* is curved and secured between the clamp assembly 42 and the head member 40 to secure the blade housing 14 to the head assembly 24. The body section 14*b* is thinner in an axial direction and extends peripherally from the lower portion 15 of the mounting section 14*a*. Stated another way, when viewed with respect to a vertical center axis V-V (FIGS. 3, 5, 6 and 7) of the blade housing, the body section 14*b* is thinner when measured along the axis V-V than the mounting section 14*a*. The vertical center axis V-V of the blade housing 14 is substantially aligned and congruent with the axis of rotation A-A (FIG. 1) of the blade 18.

The mounting section 14*a* and body section 14*b* together define a radially inwardly opening circumferential groove 16 in an inner surface of the housing that receives the blade 18 for rotation. The blade housing groove 16 establishes a horizontal plane HP (schematically shown in FIGS. 3, 6 and 7) that defines a plane of rotation of the blade 18. The horizontal plane HP of the blade housing 14 is substantially orthogonal to the axis of rotation A-A of the blade 18 and the vertical center axis V-V of the blade housing 14. The horizontal plane of the blade housing 14 is also substantially parallel to the centerline H-H of the handle assembly 12. The blade receiving groove 16 may be scalloped or fluted (best seen in FIGS. 3 & 4) to define a plurality of blade engaging faces and a plurality of fat receiving recesses and channels (best seen as 16*a* and 16*b* in FIG. 3) for directing fat out of the blade housing 14, as described in U.S. Pat. No. 6,604,288, assigned to the assignee of the present invention and incorporated in its entirety herein by reference. Alternately, the blade receiving groove may have a plurality of spaced apart blade supporting beads, as disclosed in U.S. Pat. No. 6,769,184, assigned to the assignee of the present invention. The '184 patent is incorporated in its entirety herein by reference.

Figure 6:
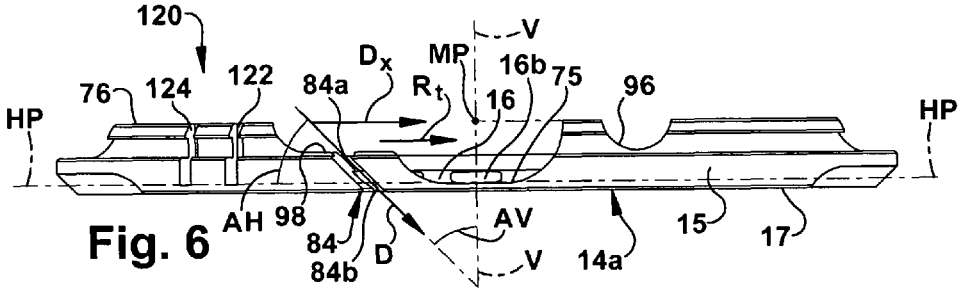
FIG. 6 is a front elevation view of the split blade housing of FIG. 2 as seen from a plane indicated by the line 6-6 in FIG. 5.
Figure 7:
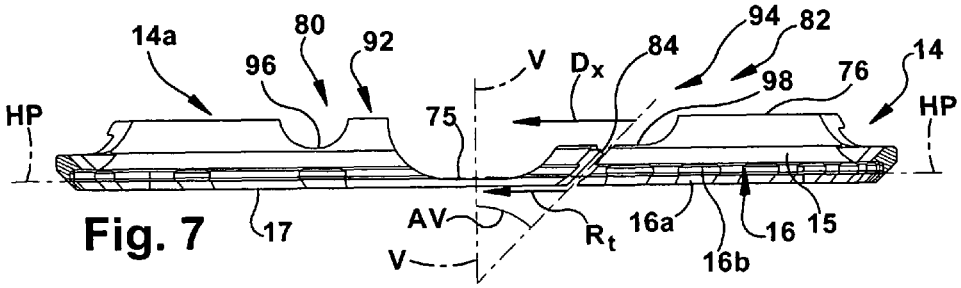
FIG. 7 is a sectional view of the split blade housing of FIG. 2 as seen from a plane indicted by the line 7-7 in FIG. 5.

Aligned with the centerline H-H of the handle assembly 12 is a generally semicircular recess 75 in the mounting section 14*a* of the blade housing 14 extending downwardly from a top 76 of the mounting section 14*a* to approximately a vertical centerpoint 16*c* (FIG. 3) of the blade receiving groove 16. The recess 75 provides clearance for the pinion gear 26 and, more particularly, the pinion gear teeth 26*a* as the teeth engage and drive the drive teeth 18*c* disposed on the upper surface of the blade body 18*a*. A horizontal midpoint MP of the recess 75 with respect to the top 76 of the mounting section 14*a* is shown in FIGS. 6 and 7. As can be seen in the Figures, the recess midpoint MP is aligned with the vertical center axis V-V of the blade housing 14.

The blade housing 14 is split to enable resilient expansion and contraction of the blade housing diameter for removing and replacing the blade 18. Advantageously, in this the exemplary embodiment of the present invention shown in FIGS. 1-9, the split 84 is angled at an angle AV (FIGS. 3, 6 and 7) with respect to the vertical center axis V-V of the blade housing 14 and is offset peripherally along the housing from the recess 75 in blade housing 14. Stated another way, the split 84 is offset peripherally from the centerline H-H of the handle assembly 12 and is also offset from the midpoint MP of the recess 75.

Figure 3:
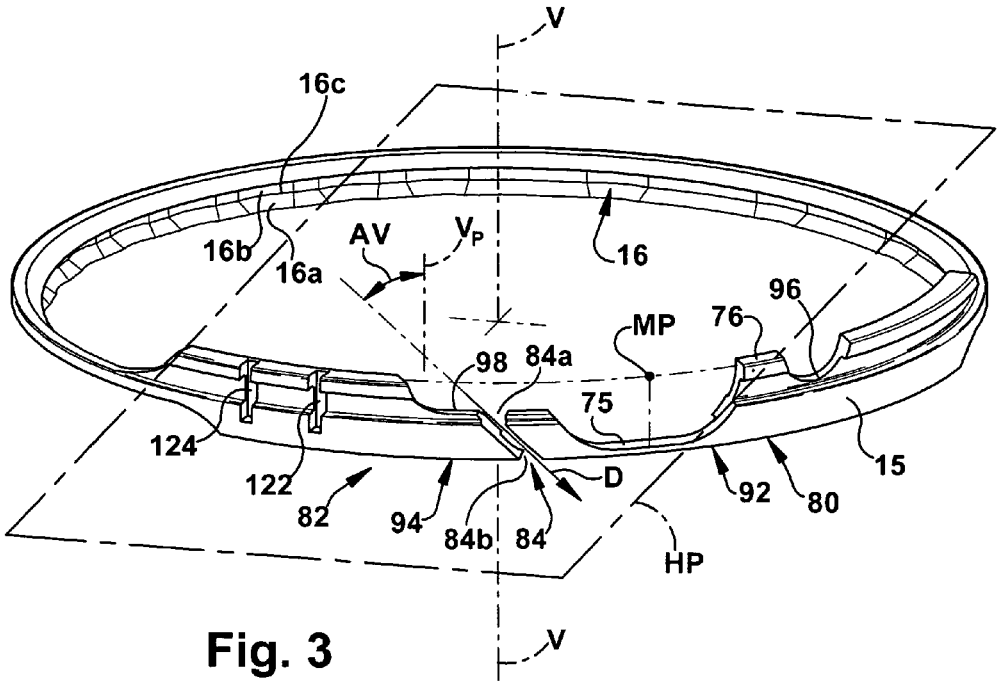
FIG. 3 is a second perspective view of the split blade housing of FIG. 2.

As can be seen in FIGS. 3 and 6, a direction D of the split 84 in the axial direction is defined as a line extending between an upper or top end 84*a* of the split to a lower or bottom end 84*b* of the split wherein the lower end 84*b* of the split is closer to the cutting edge 18*b* of the blade 18. As best seen in FIG. 3, if the vertical center axis V-V of the blade housing is projected parallel to itself (shown as Vp in FIG. 3) to intersect with the direction D of the split 84, the intersection of Vp and D form an acute angle AV. Thus, as best seen in FIGS. 6 and 7, the split 84 intersects the vertical center axis V-V at an acute angle AV. Also, the direction D forms an acute angle AH with respect to the blade rotation horizontal plane HP defined by the housing groove 16. By geometry and as seen in FIG. 6, it is clear that the sum of the two complementary acute angles AV and AH must be 90 degrees as the vertical axis H-H of the blade housing is orthogonal to the blade rotation horizontal plane HP.

Figure 5:
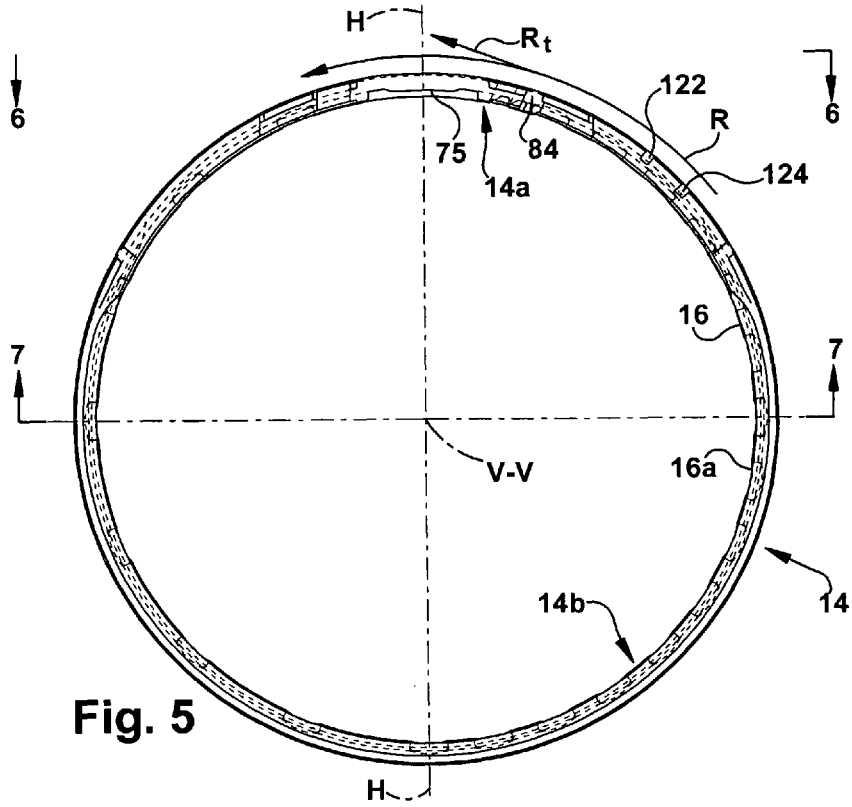
FIG. 5 is a top plan view of the split blade housing of FIG. 2.

A horizontal component Dx (FIGS. 6 and 7) of the direction D of the split 84 is advantageously aligned with a direction of rotation R of the blade 18 when the direction of rotation R is viewed at the split 84. The direction D of the split 84, as shown in the Figures, presumes a counterclockwise rotation CCW of the blade 18 when viewed from above as shown in FIG. 1. A vector R (shown schematically in FIGS. 1 and 5) represents a radial direction of rotation the blade 18. As shown in FIG. 5, at the blade housing split 84, a vector Rt represents a tangent or tangential component of the direction of rotation R of the blade 18 at the split. The vector Dx represents the horizontal component of the split direction D where the direction D is viewed from the top 84*a* of the split 84 to the bottom 84*b* of the split. As can be seen, the tangential component Rt of the direction of rotation R at the split 84 is parallel to and extends in the same direction as a horizontal component vector Dx of the split direction D (shown in FIG. 6 both Rt and Dx point to the right). Having the horizontal component Dx of the split direction D being in the same direction as the direction of rotation R of the blade 18 at the location of the split 84 minimizes the opportunity for debris deposited on the blade 18 during use to be forced up into the split 84 by rotation of the blade.

By way of example only and not as a limitation, the angle AV of the split 84 with respect to the vertical center axis V-V of the blade housing 14 may be in the range of 15 to 80 degrees, with one preferred value being 45 degrees. The particular split angle most suitable for a particular rotary knife application will depend on a number of factors including the diameter and configuration of the knife blade, the size of the blade housing, the intended use of the rotary knife, i.e., the nature of the material intended to be cut or trimmed, as well as other factors.

The peripheral position, angle and direction of the blade housing split 84 advantageously combine to reduce the likelihood for fat, meat and other debris picked up and carried with the cutting portion 18*b* of the blade 18 as the blade rotates from propensity of debris materials from the cutting section of the knife blade from being routed though an opening in the blade housing to region of engagement of the pinion gear drive teeth 16*a* and knife blade drive teeth 18*c*.

Extending circumferentially away from opposite sides are first and second end portions 80, 82 of the mounting section 14*a*. The first and second end portions 80, 82 extend circumferentially away from opposite sides of the blade housing split 84 along the handle seating region 50. The blade housing 14 is constructed and arranged so that the end portion 82 is shiftable along the handle seating region 50 relative to the end portion 80 for expanding the blade housing 14.

The end portions 80, 82 include axial extensions 92, 94 that are clamped between the clamp body 60 and the head member 40 and are construction for facilitating blade housing expansion for blade removal and replacement. The end extension 92 defines an arcuate notch 96 through which the clamp body boss 68*a* extends. The notch 96 closely conforms to the shape of the boss 68*a*. When the clamping screw 62*a* is threaded into the boss hole 69*a*, the boss 68*a* extends through the notch 96 and prevents the blade housing end portion 80 from moving with respect to the clamp face 66*a*.

The blade housing extension 94 defines an elongated reduced height section 98 that includes the split 84. The boss 68*b* extends through the reduced height section 98 when the blade housing 14 is supported on the head member 40. The length of the reduced height portion 98 assures that the blade housing end portion 82 can move freely along the confronting clamp face 66*b* toward and away from the end portion 80 when the clamp screw 62*b* is completely loosened.

The blade housing 14 is formed with an expansion structure 120 that enables the housing 14 to be resiliently expanded, while still connected to the head member 40, when the blade 18 is removed and replaced. The expansion structure 120 comprises two spaced apart axial slots 122, 124 in the blade housing outer periphery 126 adjacent the head member 40. To remove the blade 18, the clamping screw 62*b* is partially, but not completely loosened, thus maintaining some tension in the clamping screw 62*b* and, therefore, some clamping force applied to the blade housing 14. A screwdriver, or equivalent tool, is inserted in the slot 124 and levered against the head member 40 to resiliently expand the blade housing diameter. The screwdriver is then removed from slot 124 and inserted in slot 122 and levered against the head member to further resiliently expand the blade housing diameter and allow for easy removal of the blade 18 from the blade housing groove 16. Because the clamping screw 62*b* is only partially loosened and some clamping force on the blade housing 14 remains, the blade housing 14 does not snap back or return to its unexpanded diameter when the screwdriver is removed from the slot 124 and inserted in slot 122. Similarly, the residual clamping force prevents the blade housing 14 from returning to its unexpanded diameter when the screwdriver is removed from the slot 122. After the blade 18 is removed and replaced with a new blade, the screwdriver is used inserted in slot 122 and then slot 124 to urge the blade housing 14 back to its unexpanded diameter. The clamping screw 62*b* is then tightened to complete the blade replacement process.

It has been found that some operators fail to sufficiently tighten the clamping screw 62*b* after replacing the blade 18. If the clamping screw 62*b* is not sufficiently tightened, the clamping force applied to the blade housing 14 by the clamp body 60 may be sufficient to maintain the blade housing 14 in its unexpanded condition during operation of the knife 10. During operation of the knife 10, forces are applied to the blade housing 14 that tend to expand the diameter. The blade housing end portion 80 is prevented from moving by virtue of the interfitting of the notch 96 and the clamp body boss 68*a*. However, the blade housing end portion 82 is not similarly constrained and the blade housing end portion 82 may move with respect to the blade housing end portion 80, the clamp body 60 and the head member 40 if the blade housing 14 is subjected to enough force tending to expand its diameter, that is a force on the blade housing 14 that would tend to enlarge the size of the split 84.

When the clamping screws 62*a*, 62*b* are tightened, there are frictional forces between the clamp body bearing surface 66*b* and the blade housing bearing surface 67*b* and between the outer periphery of the 126 of the blade housing 14 and the head member seating region 50 that tend to keep the blade housing end portion 82 from moving with respect to the blade housing end portion 80. The frictional forces are enhanced by the provision of areas of scoring for increasing the frictional force between the blade housing and the clamp body for any given tension or tightness of the clamping screws 68*a*, 68*b*. The structure includes an area of scoring 140 (best seen in FIG. 4) on the blade housing bearing surface 67*b* and a corresponding area of scoring 142 (FIG. 8) on the clamp body bearing surface 66*b*.

In one preferred embodiment, the head assembly 24, frame member 20 and member clamp body 60 may be fabricated of aluminum castings, while the blade housing 14 and ring blade 18 may be fabricated of steel.

Figure 10:
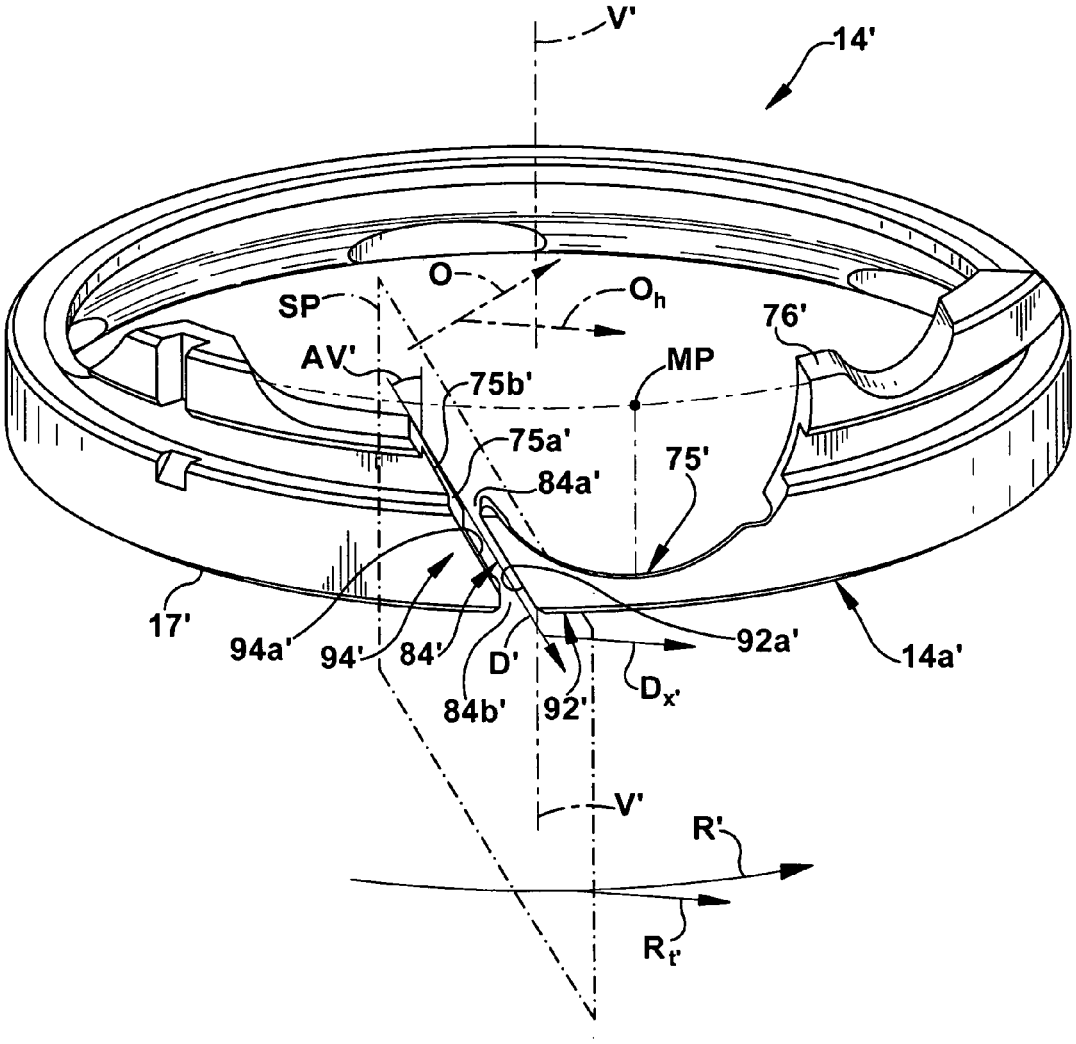
FIG. 10 is a perspective view of another exemplary embodiment of a split blade housing of the present invention.

Another exemplary embodiment of the split blade housing of the present invention is shown in FIG. 10 at 14'. This embodiment is particularly useful in rotary knives having relatively small blade diameters. Many of the features previously described above with respect to the blade housing 14 are substantially identical to the blade housing 14' will not be repeated here. As can be seen the split 84' is adjacent to and terminates into a peripheral point 75*a'* about halfway up left side outer edge 75*b'* of the pinion gear recess 75'. The split 84' is offset from the horizontal midpoint MP' of the recess 75', as the midpoint MP' is defined with regard to a top 76' of the mounting section 14*a'*.

The angle AV' of split 84' may be more vertical than the angle AV in the first embodiment, an exemplary value of the angle AV' being 30 degrees with respect to the central vertical axis V'-V' of the blade housing 14'. A direction D' is defined that represents a line extending between a top or upper end 84*a'* of the split 84' and a bottom or lower end 84*b'* of the split wherein the lower end of the split 84' is closer axially to a cutting edge of the blade than the upper end 84*a'* of the split, that is, closer to a bottom surface 17' of the blade housing. A vector Rt' represents a tangent or tangential component of a direction of rotation R' of the blade at the split 84'. As was true in the first embodiment, the horizontal component Dx' of the direction D' of the split 84' is aligned with and points in the same direction as the tangential component Rt' to the direction of rotation R' of the blade at the split 84'.

Looking at the split 84' another way, two opposing surfaces 92*a'*, 94*a'* of axial extensions 92', 94' define the split 84'. In the specific embodiment of FIG. 10, the surfaces 92*a'*, 94*a'* are planar and the split 84' forms a plane SP. (It should be noted, however, that although the present invention contemplates and includes within its scope, splits in the blade housing which may be other than a single plane, e.g., two or more planes that intersect at angles, a nonlinear or curved plane, a combination of curved and angled planes, etc.) Returning to FIG. 10, a vector O that is orthogonal to the split plane SP in a direction moving away from the cutting edge of the knife, that is, away from a bottom surface 17' of the blade housing and toward the top 76' of the mounting section 14*a'*, has a horizontal component Oh that is parallel to and points in the same direction as the horizontal component Dx' of the direction D' of the split 84'.

While the present invention has been described with a degree of particularity, it is the intent that the invention include all modifications and alterations from the disclosed embodiments falling within the spirit or scope of the appended claims.

We claim:

1. A split blade housing adapted to support an annular knife blade for rotation in a power operated rotary knife, the split blade housing comprising:

a mounting section and an body section extending from the mounting section forming a ring, the mounting section adapted to be mounted to a handle assembly of the rotary knife and includes a recess extending radially through the mounting section, the recess defining a region of reduced axial height with respect to an upper surface of the mounting section and providing clearance for a pinion gear that extends from the handle assembly to engage and drive the knife blade;

an annular groove in the housing for rotatably supporting the knife blade, the groove defining a rotational plane of the knife blade;

the mounting section including a split defining first and second end portions adjacent the split to facilitate removal of the knife blade from the housing by moving the first end portion circumferentially away from the second end portion to expand a diameter of the split blade housing, the split located within a section of reduced axial height with respect to the upper surface of the mounting section, the reduced axial height section being adjacent to the recess region of reduced axial height and peripherally offset from a midpoint of the mounting section recess; and wherein the split is peripherally offset from the horizontal midpoint of the recess of the mounting section and transverse with respect to a center vertical axis of the blade housing, wherein a direction of the split moving axially from an upper end of the split to a lower end of the split, the lower end of the split being closer to a cutting edge of the knife blade, forms an acute angle with respect to the rotational plane defined by the groove; and a component of a direction of the split when viewed from the upper end of the split to the lower end of the split is the same direction as a tangential component of a direction of rotation of the knife blade at the split.

2. The split blade housing of claim 1 wherein an angle of the split with respect to the center vertical axis of the blade housing is in a range of 15-80 degrees.

3. The split blade housing of claim 2 wherein the angle of the split is substantially 45 degrees.

4. The split blade housing of claim 1 wherein the mounting section includes one or more axial slots in an outer wall of the blade housing adapted to facilitate expansion of the blade housing diameter while the blade housing remain attached to the handle assembly.

5. The split blade housing of claim 1 wherein a portion of an inner surface of the mounting section includes an area of scoring to inhibit movement of the first end portion of the blade housing relative to the second end when the blade housing is secured to the handle assembly.

6. The split blade housing of claim 1 wherein the reduced axial height section in which the split is located is peripherally offset from the mounting section recess.

7. The power operated rotary knife of claim 1 wherein the reduced axial height section in which the split is located is peripherally offset from the mounting section recess.

8. A power operated rotary knife comprising:

an annular knife blade having a cutting edge at one axial end;

a split blade housing supporting the annular knife blade for rotation, the split blade housing including a mounting section and a body section extending from the mounting section forming a ring, the housing including an annular groove for rotatably supporting the knife blade which defines a rotational plane of the annular knife blade, the mounting section of the split blade housing adapted to be mounted to a handle assembly of the rotary knife;

the handle assembly including a head member for supporting the split blade housing and a clamping assembly including a clamp body for clamping the split blade housing to the head member, the head member supporting a pinion gear that extends from the head member to engage and drive the annular knife blade;

wherein the blade housing including a recess extending radially through the mounting section, the recess defining a region of reduced axial height with respect to an upper surface of the mounting section and providing clearance for the pinion gear extending from the head member and further including a split defining first and second end portions adjacent the split to facilitate removal of the knife blade from the housing by moving the first end portion of the split blade housing circumferentially away from the second end portion to expand a diameter of the split blade housing, the split located within a section of reduced axial height with respect to the upper surface of the mounting section, the reduced axial height section being adjacent to the recess region of reduced axial height and peripherally offset from a horizontal midpoint of the mounting section recess, and the split being offset peripherally from the horizontal midpoint of the recess and being transverse with respect to a center vertical axis of the blade housing and wherein a direction of the split moving axially from an upper end of the split to a lower end of the split, the lower end of the split being closer to the cutting edge of the knife blade, forms an acute angle with respect to the rotational plane of the knife blade; and a component of the direction of the split is in a same direction as a tangential component of a direction of rotation of the knife blade at the split.

9. The power operated rotary knife of claim 8 wherein the angle of the split with respect to the center vertical axis of the blade housing is in a range of 15-80 degrees.

10. The power operated rotary knife of claim 9 wherein the angle of the split is substantially 45 degrees.

11. The power operated rotary knife of claim 8 wherein the mounting section of the blade housing includes one or more axial slots in an outer wall of the blade housing adapted to facilitate expansion of the blade housing diameter while the blade housing remain attached to the handle assembly.

12. The power operated rotary knife of claim 8 wherein a portion of an inner surface of the mounting section of the blade housing includes an area of scoring to inhibit movement of the first end portion of the blade housing relative to the second end when the blade housing is secured to the handle assembly.

13. A split blade housing adapted to support an annular knife blade for rotation in a power operated rotary knife, the split blade housing comprising:

a mounting section and an body section extending from the mounting section forming a ring, the mounting section adapted to be mounted to a handle assembly of the rotary knife and includes a recess extending radially completely through the mounting section, the recess defining a region of reduced axial height with respect to an upper surface of the mounting section and providing clearance for a pinion gear that extends from the handle assembly to engage and drive the knife blade;

an annular groove in the housing for rotatably supporting the knife blade, the groove defining a rotational plane of the knife blade;

the mounting section including a split defining first and second end portions adjacent the split to facilitate removal of the knife blade from the housing by moving the first end portion circumferentially away from the second end portion to expand a diameter of the split blade housing, the split located within a section of reduced axial height with respect to the upper surface of the mounting section, the reduced axial height section being adjacent to the recess region of reduced axial height and peripherally offset from a horizontal midpoint of the mounting section recess; and wherein a direction of the split moving axially from an upper end of the split to a lower end of the split, the lower end of the split being closer to a cutting edge of the knife blade, forms an acute angle with respect to the rotational plane defined by the groove and a component of a direction of the split is in the same direction as a tangential component of a direction of rotation of the knife blade at the split.

14. The split blade housing of claim 13 wherein the reduced axial height section in which the split is located is peripherally offset from the mounting section recess.

15. A power operated rotary knife comprising:

an annular knife blade including a cutting edge at one axial end;

a split blade housing supporting the annular knife blade for rotation, the split blade housing including a mounting section and a body section extending from the mounting section forming a ring, the housing including an annular groove for rotatably supporting the knife blade which defines a rotational plane of the annular knife blade, the mounting section of the split blade housing adapted to be mounted to a handle assembly of the rotary knife;

the handle assembly including a head member for supporting the split blade housing and a clamping assembly including a clamp body for clamping the split blade housing to the head member, the head member supporting a pinion gear that extends from the head member to engage and drive the annular knife blade;

wherein the blade housing including a recess extending radially through the blade housing, the recess defining a region of reduced axial height with respect to an upper surface of the mounting section and providing clearance for the pinion gear extending from the head member and further including a split defining first and second end portions adjacent the split to facilitate removal of the knife blade from the housing by moving the first end portion of the split blade housing circumferentially away from the second end portion to expand a diameter of the split blade housing, the split located within a section of reduced axial height with respect to the upper surface of the mounting section, the reduced axial height section being adjacent to the recess region of reduced axial height and peripherally offset from a horizontal midpoint of the mounting section recess and wherein a direction of the split moving axially from an upper end of the split to a lower end of the split, the lower end of the split being closer to the cutting edge of the knife blade, forms an acute angle with respect to the rotational plane defined by the groove and a component of a direction of the split is in the same direction as a tangential component of a direction of rotation of the knife blade at the split.

16. The power operated rotary knife of claim 15 wherein the reduced axial height section in which the split is located is peripherally offset from the mounting section recess.

17. A split blade housing adapted to support an annular knife blade for rotation in a power operated rotary knife, the split blade housing comprising:

a mounting section and an body section extending from the mounting section forming a ring, the mounting section adapted to be mounted to a handle assembly of the rotary knife and includes a recess extending radially through the blade housing defining a region of reduced axial height with respect to an upper surface of the mounting section and providing clearance for a pinion gear that extends from the handle assembly to engage and drive the knife blade;

an annular groove in the housing for rotatably supporting the knife blade, the groove defining a rotational plane of the knife blade;

the mounting section including a split defining first and second end portions adjacent the split to facilitate removal of the knife blade from the housing by moving the first end portion circumferentially away from the second end portion to expand a diameter of the split blade housing, the split located within a section of reduced axial height with respect to the upper surface of the mounting section, the reduced axial height section being adjacent to the recess region of reduced axial height and peripherally offset from a horizontal midpoint of the mounting section recess; and wherein opposing surfaces of the first and second end portions are planar and the split defines a plane such that a vector that is orthogonal to the split plane in a direction moving away from a cutting edge of the knife blade, a component of the orthogonal vector is in the same direction as a tangential component of a direction of rotation of the knife blade at the split.

18. The split blade housing of claim 17 wherein the reduced axial height section in which the split is located is peripherally offset from the mounting section recess.

* * * * *